US005195428A

United States Patent [19]

Gawlitta et al.

[11] Patent Number: 5,195,428

[45] Date of Patent: Mar. 23, 1993

[54] PRESS FOR PRODUCING PRESSED BOARD BY TREATING THE MATERIAL WITH STEAM

[75] Inventors: Werner Gawlitta, Tegelen, Netherlands; Karl Walter, Kempen; Stephan Schulz, Krefeld, both of Fed. Rep. of Germany

[73] Assignee: G. Siempelkamp GmbH & Co., Krefeld, Fed. Rep. of Germany

[21] Appl. No.: 696,578

[22] Filed: May 7, 1991

[30] Foreign Application Priority Data

May 11, 1990 [DE] Fed. Rep. of Germany ..... 4015142

[51] Int. Cl.[5] ..... B30B 15/34

[52] U.S. Cl. ..... 100/73; 100/93 P; 425/405.1; 425/406; 425/420

[58] Field of Search ..... 100/73-75, 100/92, 93 P, 93 RP, 151; 425/394, 405.1, 406, 420; 68/6, 222

[56] References Cited

U.S. PATENT DOCUMENTS

| | | | |
|---|---|---|---|
| 3,295,167 | 1/1967 | Corbin | 100/93 P X |
| 3,372,499 | 3/1968 | Gilbert | 68/222 X |
| 3,517,610 | 6/1970 | Siempelkamp | 100/93 P X |
| 4,162,877 | 7/1979 | Nyberg | 425/406 X |
| 4,357,194 | 11/1982 | Stofko | 425/405.1 X |
| 4,409,170 | 10/1983 | Stofko | 425/420 X |
| 4,504,205 | 3/1985 | Stofko | 100/93 P X |
| 4,850,849 | 7/1989 | Hsu | 425/406 X |
| 4,923,555 | 5/1990 | Elliott et al. | 100/74 X |
| 5,063,010 | 11/1991 | Fischer et al. | 425/405.1 X |

FOREIGN PATENT DOCUMENTS

| | | | |
|---|---|---|---|
| 570005 | 2/1933 | Fed. Rep. of Germany | 100/93 P |
| 62-275600 | 11/1987 | Japan | 100/93 P |

*Primary Examiner*—Harvey C. Hornsby
*Assistant Examiner*—Stephen F. Gerrity
*Attorney, Agent, or Firm*—Herbert Dubno

[57] ABSTRACT

A press for the production of pressed board with injection of steam utilizes press platens to which the steam is fed to the steam-feed channels from opposite sides in a collision flow, the channels communicating with steam-nozzle bores opening at the pressing surface and such that the cross section of each channel is equal to at least 60% of the total flow cross sections of the boards communicating with that channel. Before the pressing commences, the channels are through-flushed with steam to flush air from the channels and bores and to evacuate air from the pressed mat by a venturi effect.

9 Claims, 6 Drawing Sheets

PRESS FOR PRODUCING PRESSED BOARD BY TREATING THE MATERIAL WITH STEAM

FIELD OF THE INVENTION

Our present invention relates to a press for the production of pressed board and to a method of operating same. More particularly, the invention relates to the production of pressed board, e.g. chip board, particle board, fiber board and the like construction materials, from a mat or pressable materials, usually cellulosic materials, under heat and pressure and with the injection of steam into the mat. Specifically the invention relates to an improved press platen for such a press and a method of producing pressed board utilizing a press having the improved press platen.

BACKGROUND OF THE INVENTION

The fabrication of pressed board by the compaction of a mat of wood chips, fibers, or dust or other cellulosic particles, with or without an extrinsic thermally-activated binder, can make use of cycling or continuous presses as will be described in greater detail below.

The presses can have press plates or platens which can be composed of steel and which can have mutually parallel steam-supply channels which can communicate with steam nozzle bores or orifices arrayed along each channel and opening at a surface of the platen turned toward the mat. The channels may communicate a steam distribution manifold Between the mouths of the orifices or nozzles, and the mats, screens or sieves of steel wire or porous ceramic may be provided to improve the steam distribution.

As noted, the presses may be cycling presses in which, in each cycle, the mat is charged onto a press platen when the press is open and the press is then closed to compact the mat between two platens. In continuously operated presses, the mat is entrained into the press between a pair of press belts which can be permeable so that the steam from the press platen can penetrate into the particle mass forming the mat. Usually both press platens or press plates are provided with the channels and orifices for feeding steam to the mat although, for the purposes of the present application, only a single such plate or platen may be described, it being understood that the opposite press plate or platen may likewise be similarly equipped with the steam channels and orifices.

The steam nozzle bores frequently are simply referred to as steam nozzles or orifices.

The mat comprises a particulate material which, as noted, can be sawdust or similar particles, wood chips or fibers, e.g. of wood or cellulose, and a binder This binder may be natural resins present in the wood and/or thermally-activatable binders added separately to the particles and thus incorporated in the mat when the latter is shaped.

The steam serves to provide the heat required for the reaction of the binder in the mat which is generally under compression between the press plates or platens. The quantity of steam required is thermodynamically determined. It must supply the thermal energy required for the hardening process to the extent that the thermal energy is not supplied by other heating of the press platens.

In practice it has been found to be of considerable importance to provide a uniform distribution of the steam within the mat so that the latter is uniformly heated. The steam channels are thus uniformly distributed and are generally equidistant from one another and the bores are generally uniformly distributed over the area of the press platen.

However, in spite of the efforts to maintain a uniform feed of the steam of the pressed board or mat within the press, it has been found that the flow of steam is nonuniform in practice For example, the flow velocity falls off with distance along the flow channel and the transition between the nozzle and feed channel requires a direction change so there may be local counterflow which may interfere with uniform distribution of the steam. With the length of the flow passage, moreover, the temperature also tends to fall off. As a consequence, the uniformity of the distribution of the steam to the mat to be pressed requires improvement. Indeed, one of the approaches to such improvement has been the use of screens in the aforementioned manner between the press platen and the mat.

OBJECTS OF THE INVENTION

It is, therefore, the principal object of the present invention to provide a press for the purposes described which will have improved uniformity of the distribution of the steam to the article to be pressed.

Another object of this invention is to provide an improved press platen, especially for a press for the production of pressed board, which affords a more uniform distribution of the steam to the press mat.

It is also an object of our invention to provide an improved method of operating a press for the production of press board or an improved method of making pressed board, whereby drawbacks of earlier systems are avoided

SUMMARY OF THE INVENTION

These objects and others which will become apparent hereinafter are attained, in accordance with the invention, in a press for the production of pressed board by compression of a mat with heat and pressure and with injection of steam into the mat, the press comprising:

at least one steel press platen formed with a surface turned toward the mat and a plurality of mutually parallel steam-supply channels opening along opposite sides of the platen, the platen having respective groups of steam-nozzle bores arrayed along each of the channels, communicating with the respective channel and opening at the surface, each of the channels having a flow cross section which is at least 60% of a sum of the flow cross sections of the bores of the respective group arrayed along the channel where the bores communicate with the channel; and respective steam-distribution ducts formed along each of the sides of the platen, transverse to the channels and communicating with the respective ends of the channels at the respective side for feeding steam to the channels whereby the steam fed to the channels from the respective ducts flows in collision paths in the respective channels in opposite directions.

Preferably, each of the channels has a cross section which is at least 80% of the sum of the flow cross sections of the bores of the respective group arrayed along the channel at the locations at which these bores communicate with the channel In the most preferred embodiment, however, the cross section of each individual channel is greater than the sum of the cross sections of all of the bores communicating with that channel.

The invention is based upon our discovery that distribution of the steam with an extremely high uniformity in the mat and pressed material can be obtained when steam is fed to each of the channels simultaneously into opposite directions from the opposite ends of each channel so that there is a collision flow of steam from the opposite ends of the channel, the steam from this collision flow entering the boards. This, in combination with the relationship of the flow cross sections of the bores relative to the flow cross section with respective channel ensures elimination of detrimental temperature and pressure drops or gradients within the channels or from bore to bore along the channel.

It has been found to be advantageous to provide all of the steam-feed channels with the steam flow cross section and further so that all of the steam-nozzle bores have the same diameters, at least where these bores open into the respective channels The bores can all have the same configuration.

The steam-feed channels and the steam nozzle bores can be uniformly distributed with a predetermined pattern bore spacing, i.e. in a predetermined raster. In a preferred embodiment of the invention, the steam bore axes can intersect the axes of the feed channels and each bore can be paired with another so the axes of the pair form a V symmetrical with respect to a vertical In this manner we are able to provide the steam-nozzle bores in an extremely closely spaced relationship with a uniform distribution and in a predetermined grid pattern while the spacing between the steam-supply channels can remain relatively large so that the aforementioned cross section ratio can be maintained without difficulty.

It has been found to be advantageous to provide the steam-nozzle bores with an increasing cross section outwardly of the region at which they communicate with the channels. In this manner the velocity of the steam at the mouth of each bore can be reduced. The widening of the cross section of the steam-nozzle bores can be continuous or in a stepwise manner.

It has been found to be advantageous, moreover, to provide the press platen on the side thereof opposite the surface at which the steam-nozzle bores open and hence rearwardly from the mat of the steam-feed channels, with additional heating passages which can be traversed by a flowable heating agent. The heating through these additional passages can be continuous so that it is not started or stopped in accordance with cycling of the press.

It has been found to be advantageous, moreover, to provide on both sides of the platen, utility pipes which communicate with the steam-distribution ducts or manifolds via multiple passages or connectors and which can be connected, in turn, to a steam source or a suction source selectively in accordance with a predetermined program. When a cyclable press is so equipped, it is advantageous before each pressing cycle or before closure of the press on a respective mat to feed steam through the press platen to flush air from the channels and bores. Before the press is opened, moreover, steam can be evacuated from the pressed board by connecting the suction source of the utility pipe.

It will be understood that in the lines running to the steam source and the suctions source, corresponding valves can be provided and the cross sectional areas of the utility pipes and the connectors, as well as the flow cross sections or nominal values of the valves can be so selected that the desired distribution of the steam reflected in the ratio of the cross sectional areas of the flow channels and of the bores connected thereto will be maintained.

More particularly, the method of operating a cyclable press having openable and closable press platens for the production of pressed board can comprise the steps of:

(a) with the platens open, feeding steam through channels in at least one of the platens having bores communicating with the channels and opening at a surface turned toward the mat, thereby flushing air from the channels;

(b) closing the platens on the mat and pressing the mat between the platens with heat and pressure and by injecting steam into the mat through the bores to transform the mat into a pressed board; and (c) opening the platens and removing the pressed board from the press.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 8:
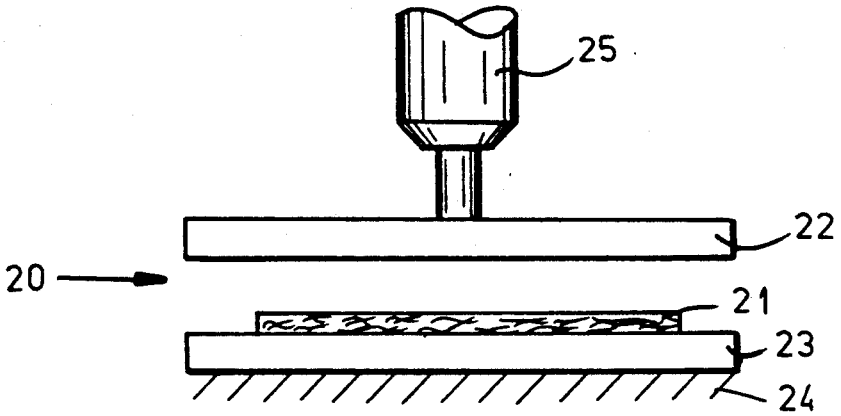
FIG. 8 is a diagram of a cycling press showing the mat between a pair of press platens which themselves can be constructed as described in connection with FIGS. 1–6 and which can be operated in accordance with the cycling system of FIG. 7.
Figure 9:
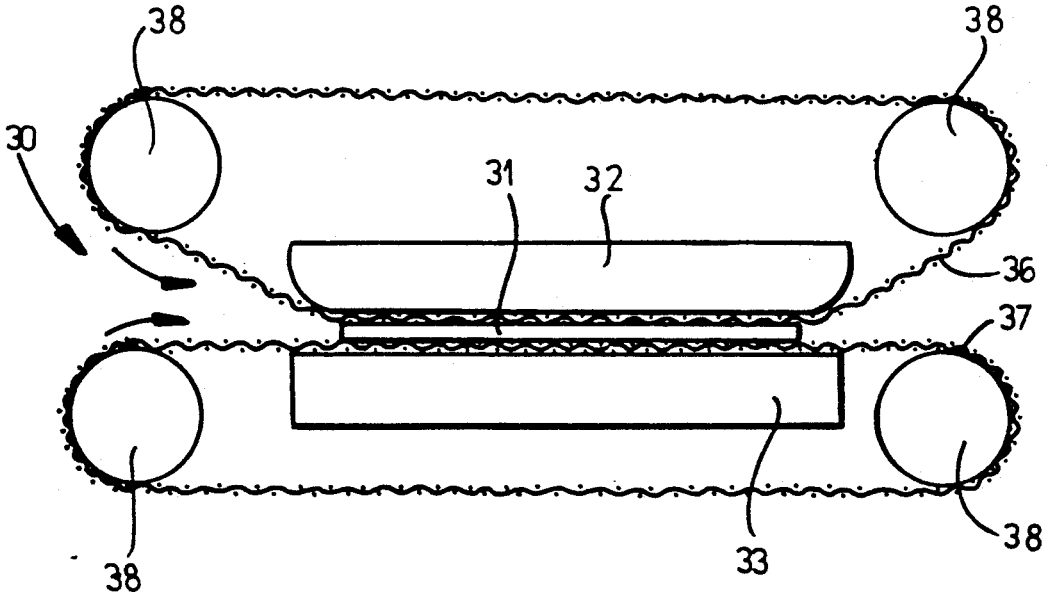
FIG. 9 is a diagram illustrating a continuous press which can be provided with press platens as described in connection with FIGS. 1–6.

Referring first to FIG. 8, it can be seen that a press 20 for the pressing of a mat 21 of particles, especially cellulosic particles or wood particles admixed with a thermally-activatable binder, can comprise a pair of press platens 22 and 23, the latter being mounted upon a suitable support 24 while the former is provided with means represented by the hydraulic cylinder 25 for applying the press pressure when the press is closed.

The press of FIG. 8 can have platens which are constructed as will be described below like the platen 1 and equipped with the manifold system for supplying steam thereto which is also described below. That press can be operated with the cycle system described in connection with FIG. 7.

Alternatively, the press of the invention may be a continuously-operating press 30 in which a mat 31 is continuously fed between two platens 32 and 33 on press belts 36 and 37 passing around rollers 38, the belts being metal screens or the like permeable to steam. In this case, the platens 32 and 33 may have the construction described for the platens 1 in FIGS. 1–6.

Figure 1:
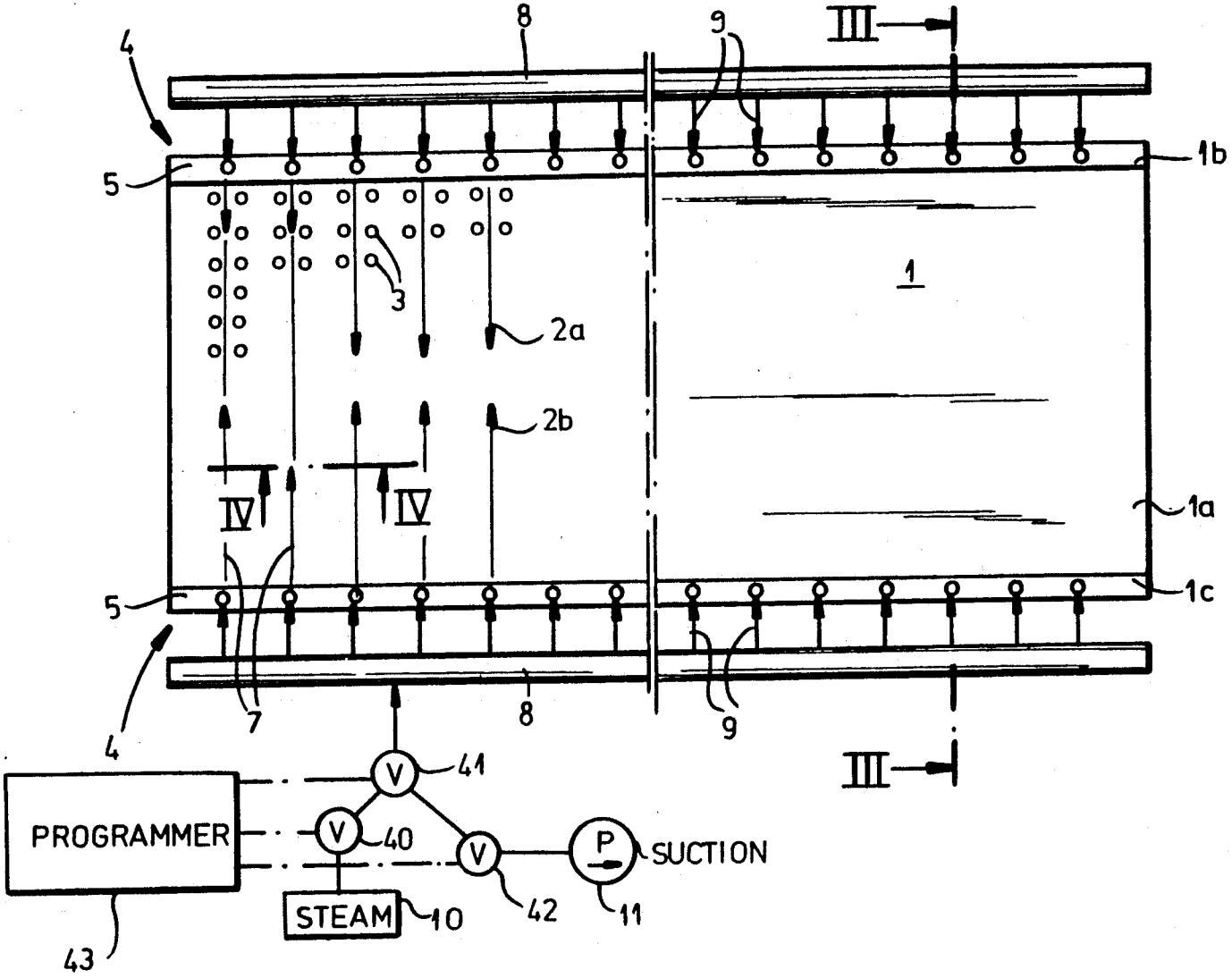
FIG. 1 is a diagrammatic plan view of a press platen showing the connection of the steam-distribution ducts therewith.

As can be seen from FIG. 1, a press plate or platen 1 for the production of a particle board, especially a chip board or fiber board from a mat of a thermally-activatable binder and the particles using heat and pressure and the introduction of steam into the mat or board, can be composed of steel.

On the side of the platen having the pressing surface 1*a*, that platen can be formed with mutually parallel steam-feed channels 2 which extend transversely to the length of the plate and open at the opposite sides 1*b* and 1*c* of the press plate.

Each of these channels communicates with a group or array of steam-nozzle bores 3 opening at the surface 1*a*. The channels 2 communicate at both of their ends with respective steam-distribution ducts 5 which extend along the sides 1*b* and 1*c* and form respective steam distributors 4 which feed steam in opposite directions as represented by the arrows 2*a* and 2*b* in FIGS. 1 and 3.

Figure 2:
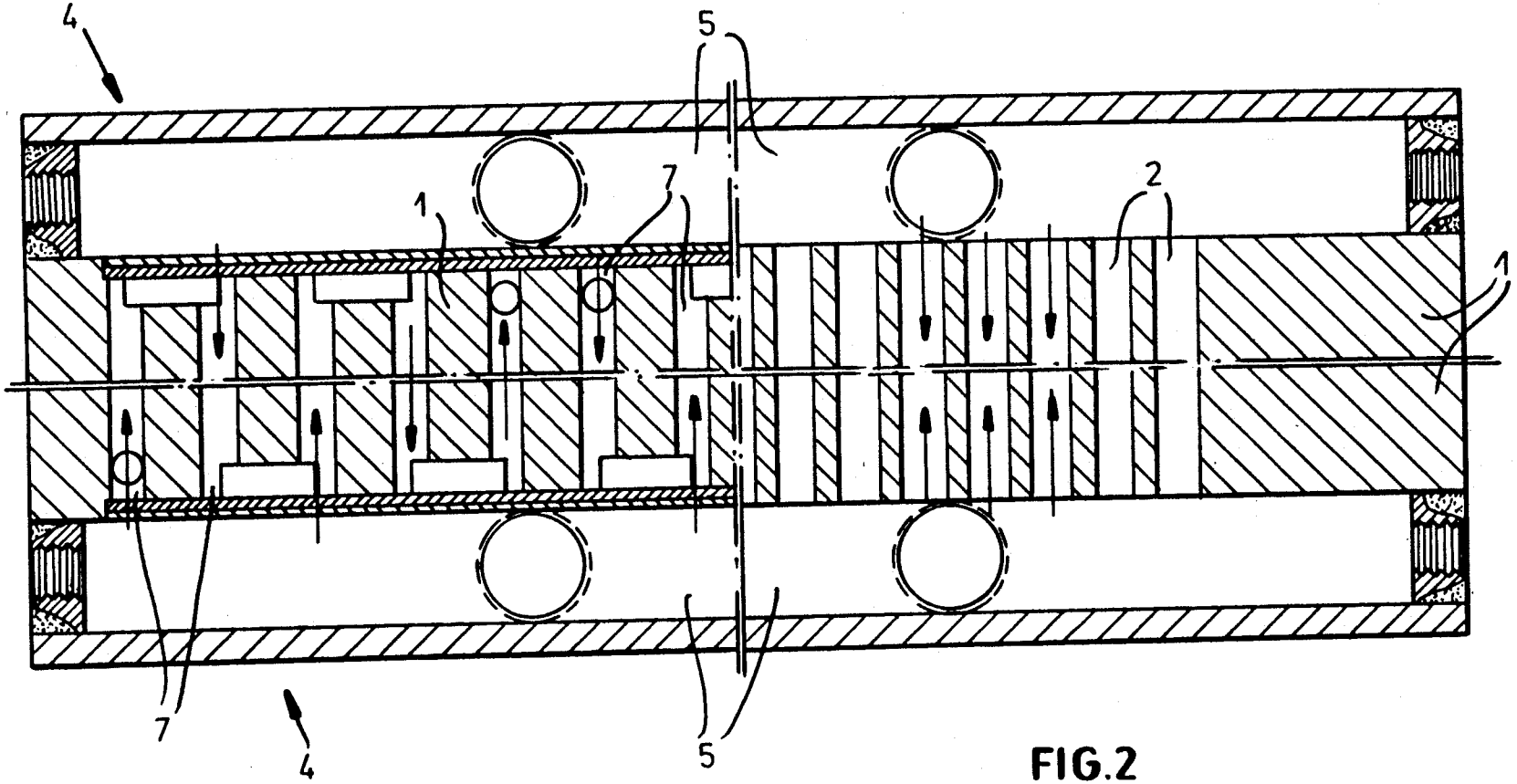
FIG. 2 is a cross sectional view greatly enlarged in scale by comparison to FIG. 1 and representing a horizontal section through the platen of FIG. 1, on the right-hand side illustrating the steam-supply channel and at the left-hand side illustrating the heating passages which lie below the steam-supply channels.
Figure 3:
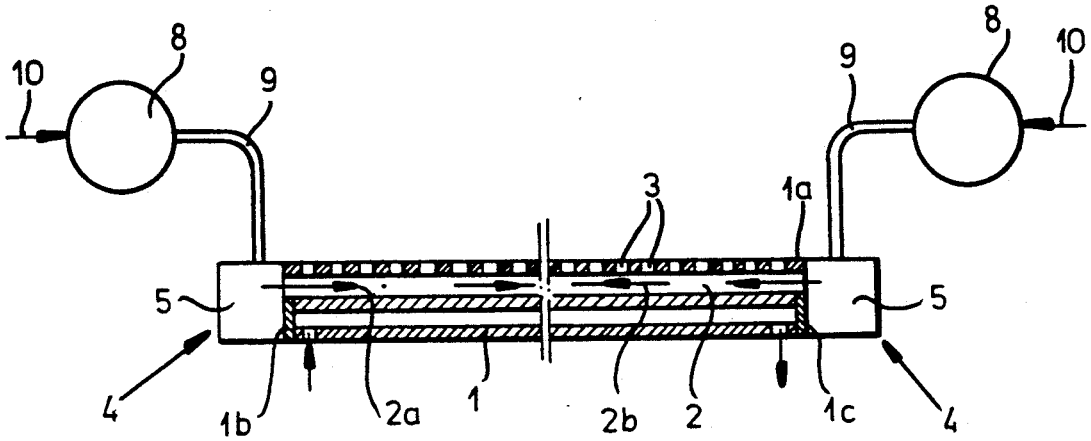
FIG. 3 is a cross sectional view taken along the line III—III of FIG. 1 through a press platen modified with respect to the embodiment of FIG. 1.
Figure 5:
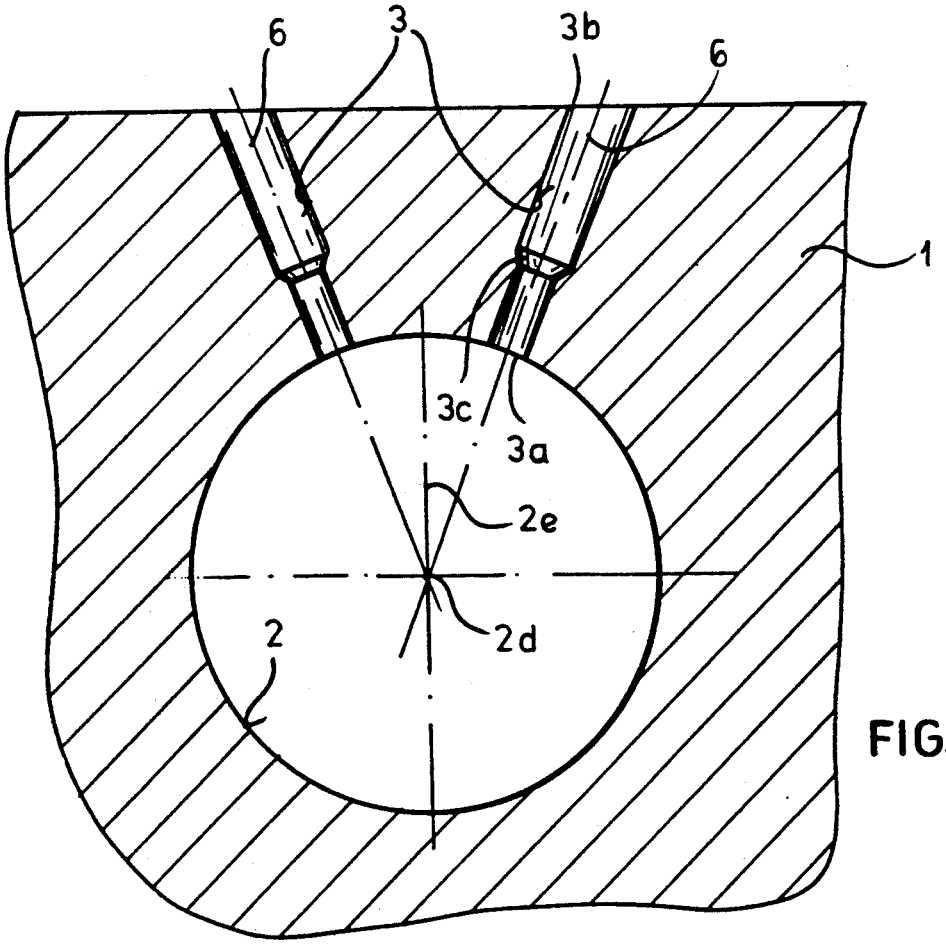
FIG. 5 is an enlarged detail view of the region V of FIG. 4.
Figure 6:
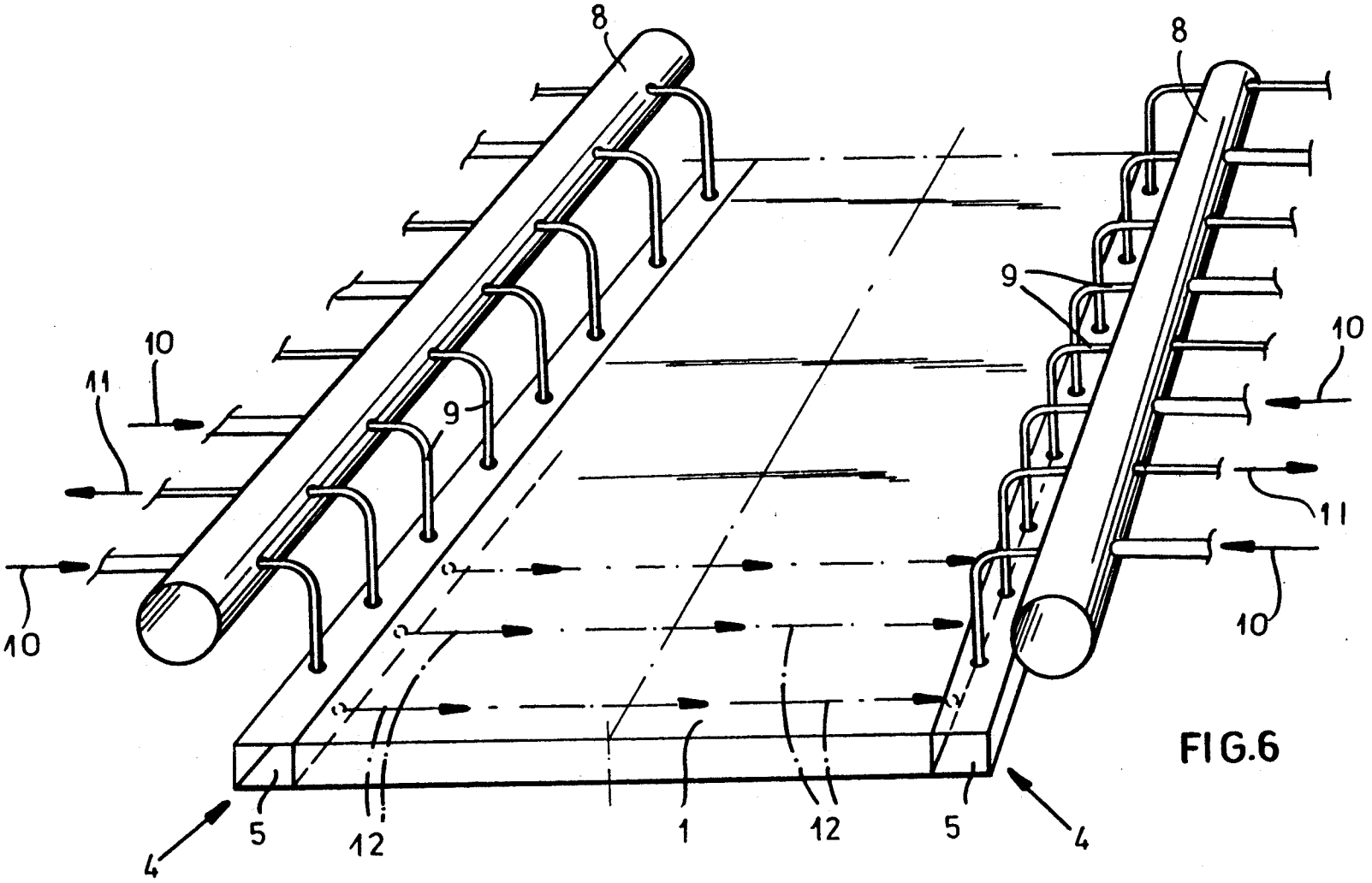
FIG. 6 is a diagram illustrating the operation of a press in accordance with the invention.

In the embodiment of FIGS. 1–3 and also as shown in FIG. 6, for clarity of illustration, the spacing between the bores 2 and the spacing between the bores 3 has been illustrated as substantially greater relative to the diameters of these bores than will be the case in practice. In practice, the distribution will be closer to that represented in FIGS. 4 and 5.

The diameters of the bores forming the channels 2 can be in the range of 30 to 40 mm, although smaller diameters may be provided as desired. The diameters of the steam-nozzle bores 3 can be of the order of several mm, for example in the range of 2.5 to 3 mm, where those bores open into the channels 2.

Turning again to FIG. 1, it can be seen that the two distribution ducts 5 lie along the opposite sides of the plate 1, communicating with the opposite ends of the bores 2 and run transversely to the latter. The arrows 2*a* and 2*b* in FIG. 1 show that the steam in each of the channels 2 and from the two ducts 5 flows in opposite directions to establish a collision flow within each channel.

Figure 4:
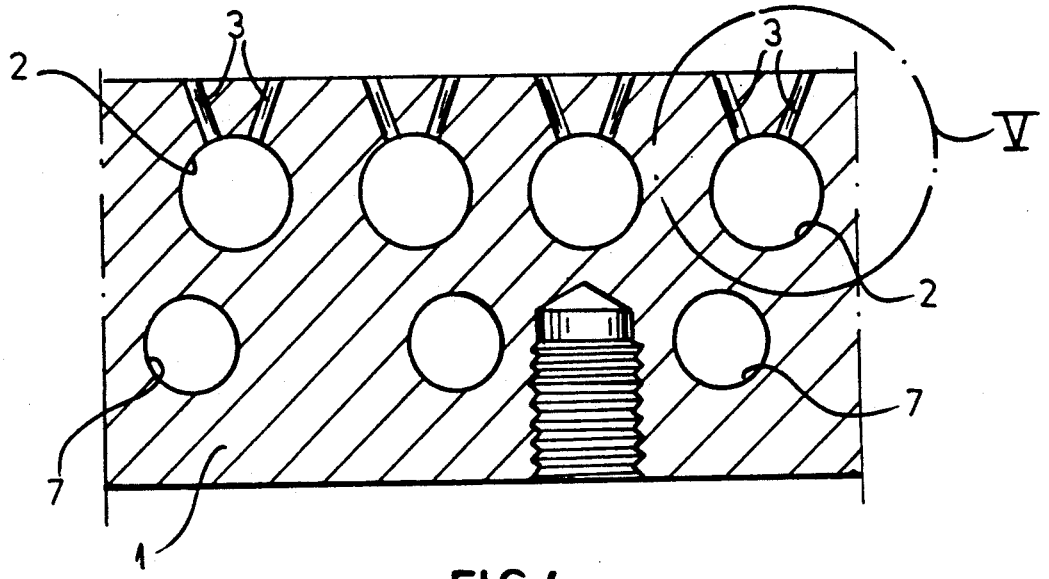
FIG. 4 is a section drawn to a somewhat larger scale but corresponding to a cross section along the line IV—IV of FIG. 1.

As a comparison of FIGS. 4 and 5 will demonstrate, the flow cross section of each channel 2 is at least 60% and preferably at least 80% of the sum of the cross sections of all of the bores 3 communicating with that channel at the locations 3*a* at which these bores open into the channel 2. The number of steam-nozzle bores 3 communicating with each channel is thus appropriately selected so that this ratio will apply. Preferably the cross section of the individual channels 2 is greater than the sum of the cross sectional areas of all of the bores 3 communicating therewith at the respective locations 3*a*.

All of the channels 2 have the same cross sections and all of the steam-nozzle bores may have the same cross sections and can be identical to one another. As will be apparent from FIG. 5, the steam-nozzle bores 3 widen toward their mouths 3*b* and in the embodiment of FIG. 5, this widening is effected by stepping bores, one such step being illustrated at 3*c* in FIG. 5.

From FIGS. 4 and 5, it will also be apparent that the steam-nozzle bores 3 have axes 6 which intersect the axis 2*d* of the respective channel 2 and that the bores 3 are paired so that the axis of the bores of each pair extend in the form of a V symmetrically with respect to a vertical 2*e*. As a consequence, the bores 3 can be provided with an exceptionally close spacing but uniform distribution in accordance with a predetermined grid pattern (see FIG. 1).

FIGS. 2 and 4 also illustrate clearly that the press plate, at its side turned away form the mat 21 or 31 is additionally formed with heating passages or bores 7 traversed by a fluid heating medium which can continuously flow through the plate independently of the cycling thereof, this heating medium being superheated steam, for example.

The form of the heating passages 7 and their distribution can follow conventional laws and can serve to counteract any tendency toward bending of the plate 1 because of the temperature differential or heating thereof.

From FIG. 6 it can be seen that along each of the distribution ducts 4, a respective utility pipe 8 can be disposed, the utility pipes being connected to the distribution ducts 5 by spaced-apart connecting pipes 9 so that each utility pipe forms a manifold uniformly connected to the duct 5. The utility pipes 8 can be selectively connected to a steam source 10 represented by an arrow in FIG. 6 or to a suction source 11, also represented by an arrow in this Figure.

In FIG. 1, the suction source 11 has been represented as a suction pump while the steam source has been represented as the steam generator 10, the steam and suction sources being connected by valves 40, 41 and 42 with the respective utility pipe 8. The valves are controlled by a programmer 43.

Figure 7:
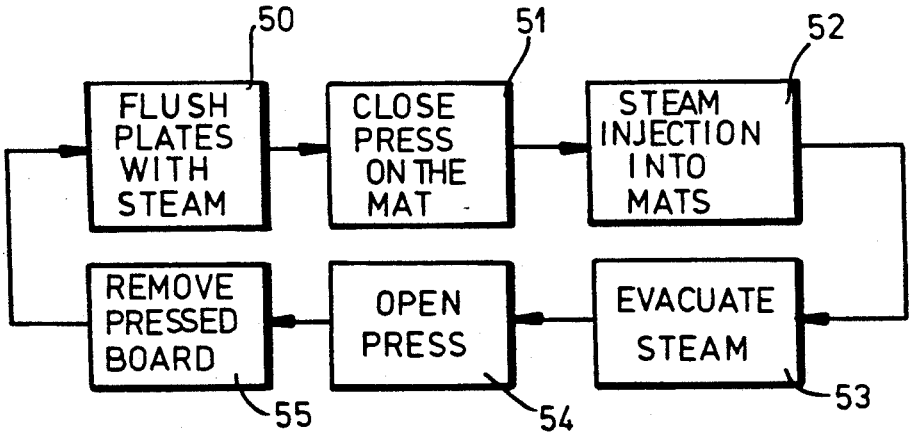
FIG. 7 is a block diagram showing the steps in the cycling of a cyclable press in accordance with the invention.

Referring to FIG. 7, it can be seen that a cycle of operating the press 8 having the platens of FIGS. 1–6 can involve, when the platens are open, a flushing of the platens with steam in an initial step 50, followed by closure of the press on the mat at 51 to press the mat with heat and pressure to form the pressed board. Steam is injected during this step at 52 and at the conclusion of the hardening stage, steam can be evacuated at 53, the press opened at 54 and the pressed board removed as represented at 55.

Since, before each press cycle, the channels 2 are flushed with steam, air can be removed. This flushing can continue from one side of the press platen so that when the press is closed, a venturi effect is exerted to draw air via the boards 3 out of the compacted mat (see the arrows 12 in FIG. 6). Only then is steam fed from opposite sides into the platen for the steam injection phase of the cycle. After the boards have hardened sufficiently, both ends of each channel 2 are connected to the suction source to evacuate steam prior to the opening of the press.

We claim:

1. A press for the production of pressed board by compression of a mat with heat and pressure and with injection of steam into the mat, said press comprising:

at least one steel press platen formed with a surface turned toward said mat and a plurality of mutually parallel steam-supply channels opening along opposite sides of said platen, said platen having respective groups of steam-nozzle bores arrayed along each of said channels, communicating with the respective channel and opening at said surface, each of said channels having a flow cross section which is at least 60% of a sum of the flow cross sections of the bores of the respective group arrayed along the channel where said bores communicate with the channel;

a source of steam;

respective steam-distribution ducts connectable to said source and formed along each of said sides of said platen, transverse to said channels and communicating with the respective ends of said channels at the respective side for feeding steam to said channels whereby the stem fed to said channels from the respective ducts flows in collision paths in the respective channels in opposite directions;

utility pipes extending along said ducts parallel thereto;

a multiplicity of passages spaced along said ducts and connecting each of said ducts with the respective utility pipe; and programmable means connected to said pipes for selectively supplying steam to said pipes and connecting said pipes to a suction source.

2. The press defined in claim 1 wherein each of said channels has a flow cross section which is at least 80% of the sum of the flow cross sections of the bores of the respective group arrayed along the channel where said bores communicate with the channel.

3. The press defined in claim 2 wherein each of said channels has a flow cross section which is greater than the sum of the flow cross sections of the bores of the respective group arrayed along the channel where said bores communicate with the channel.

4. The press defined in claim 1 wherein all of said channels have substantially the same flow cross section.

5. The press defined in claim 1 wherein all of said bores are circular and of diameters which are equal.

6. The press defined in claim 1 wherein the bores arrayed along each channel have axes intersecting an axis of the respective channel and said bores are paired so that axes of the bores of each pair form a V and are oriented symmetrically to a vertical.

7. The press defined in claim 1 wherein said bores have cross sections which increase outwardly from the respective channel.

8. The press defined in claim 1 wherein said platen is formed along a side thereof turned away from said surface with heating-fluid passages traversed by a heating fluid independently of steam fed to said channels.

9. The press defined in claim 1 wherein said press is a cycling press having openable and closable press platens and means for cycling said platens between open and closed positions.

* * * * *